US005158435A

United States Patent [19]

Eardley

[11] Patent Number: 5,158,435

[45] Date of Patent: Oct. 27, 1992

[54] IMPELLER STRESS IMPROVEMENT THROUGH OVERSPEED

[75] Inventor: Edward P. Eardley, Amherst, N.Y.

[73] Assignee: Praxair Technology, Inc., Danbury, Conn.

[21] Appl. No.: 792,394

[22] Filed: Nov. 15, 1991

[51] Int. Cl.[5] ..... B23P 15/04

[52] U.S. Cl. ..... 416/241 R; 29/889.2; 72/80

[58] Field of Search ..... 29/889.2; 72/80, 483; 416/241 R

[56] References Cited

U.S. PATENT DOCUMENTS

| | | | |
|---|---|---|---|
| 1,666,581 | 4/1928 | Rainaud | 72/80 |
| 1,763,256 | 6/1930 | Ray | 416/241 R |
| 4,060,707 | 11/1977 | Olsson et al. | 72/80 |
| 4,335,997 | 6/1982 | Ewing et al. | 416/241 R |
| 4,772,336 | 9/1988 | Enomoto et al. | 148/11.5 Q |
| 4,879,793 | 11/1989 | Stuecker et al. | 29/156.8 R |

*Primary Examiner*—Irene Cuda
*Attorney, Agent, or Firm*—Peter Kent

[57] ABSTRACT

A method for improving the capability of a body to withstand stress during rotation of the body by inducing at a selected location in the body a residual compressive stress which opposes the steady tensile stress produced by rotation. The method comprises rotating the body at a succession of increasing peak speeds in excess of the design speed to induce tolerable yielding and residual compressive stress at each location experiencing higher steady tensile stress than the selected location. The succession proceeds from the location experiencing the highest steady tensile stress above that at the selected location to the location experiencing the lowest steady tensile stress above that at the selected location. Then the body is rotated to a still higher peak speed to induce tolerable yielding and residual compressive stress at the selected location.

8 Claims, 6 Drawing Sheets

IMPELLER STRESS IMPROVEMENT THROUGH OVERSPEED

TECHNICAL FIELD

The present invention relates to a method of improving the operating stress capability of a body to be subjected to rotation, and particularly to a method of introducing residual beneficial stress at a selected location in a turbomachine impeller where the operating stress level is of concern.

BACKGROUND

A limiting factor in improving the performance of a turbomachine is often the rotational speed at which the impellers of the machine can operate. The stress levels developed in the impellers often prohibit operation at higher speeds which would provide greater performance. Structural considerations often run counter to aerodynamic considerations in the design of impellers. Advanced aerodynamic features such as thin blades, blade shrouds, backward blade curvature, and reduced impeller weight all incur higher operating stresses than more conservative features and therefore tend to reduce the possible operation speed. The costs associated with introducing such advanced features also are high, and suitable materials and methods of manufacturing are limited. Thus it is desirable to be able to reduce operating stress levels in such impellers to allow their operation at higher rotational speeds.

During operation of a turbomachine impeller, stresses occur and vary continuously throughout the impeller, being a combination of primary and secondary stresses created by the applied forces and the impeller's configuration. Primary stresses are developed by imposed loadings on the impeller, such as the centrifugal force produced by rotation of the impeller. A basic characteristic of a primary stress is that it is not self limiting. Primary stresses which considerably exceed the yield strength of the impeller material cause gross distortion or rupture of the impeller, which shall be termed failure of the impeller.

Secondary stresses are developed in the impeller by the constraints imposed by adjacent parts or by the impeller itself, that is, by self constraint. A basic characteristic of a secondary stress is that it is self limiting. Local yielding and distortions can occur as a result of secondary stresses, but failure does not usually occur from secondary stresses. Residual stresses, by their nature, are secondary stresses which can be developed through the application of both primary and secondary stresses to the impeller.

In operation, vibratory stresses are also produced by the dynamic environment of the impeller and are superimposed on the steady stresses. Vibratory stresses can quickly cause fatigue fracture of the impeller.

As used herein, "residual stress" shall mean internal stress existing in a material with no external forces applied, developed by the material itself, that is, by self constraint in the material.

As used herein, "compressive stress" shall mean a stress which causes a material to shorten in the direction of the applied force producing the stress.

As used herein, "tensile stress" shall mean a stress which causes a material to lengthen in the direction of the applied force producing the stress.

As used herein, "steady stress" shall mean a stress that does not vary with time if all external forces are steady, that is, do not vary with time, as distinguished from alternating or vibratory stress.

As used herein, "yielding" shall mean plastic deformation or permanent change in shape or size of a material, without fracture, resulting from the application of a stress.

As used herein, "tolerable yielding" shall mean yielding only to an extent which does not render an object unsuitable for further functioning intended for the object, such as yielding which does not change the shape or size or balance of an object so as to render it unsuitable for further functioning as intended.

This invention may be applied to any structure or device in which the applied loading creates a distributed primary stress field such that there are localized regions of high primary and secondary stress uncoupled from each other, uncoupled in the sense that they do not share a common geometric constraint. In addition the structure or device must be of a material which has adequate ductility to permit reasonable yielding or plastic deformation without fear of failure. A typical metal turbomachine impeller is such a structure.

The steady stresses occurring in a typical metal turbomachine impeller during operation may be computed by known methods such as finite element analysis. Steady stresses are produced by centrifugal forces due to rotation of the impeller, temperature differences between different regions of the impeller, and dynamic pressure forces imposed by fluids contacting the impeller.

In rotational operation of an impeller, peak stresses occur at various locations in the impeller. Increasing the capability of just these specific locations to withstand stress increases the operating capability of the impeller. A method for improving the capability of a specific location to withstand stress during rotation is to induce a beneficial residual stress at the location. Since the peak stresses are usually tensile, inducing a residual compressive stress is usually beneficial. A method for inducing a residual compressive stress at a specific selected location is to overstress the location so that local yielding occurs at the location. Upon relieving the momentary overstress, the unyielded material surrounding the yielded material exerts a residual compressive stress upon the yielded material. This can be accomplished in an impeller at a location experiencing the highest steady tensile stress by rotating the impeller to a peak speed higher than the design speed so as to develop a tensile stress which induces tolerable local yielding at this location.

In an impeller, a location particularly subject to the development of vibratory stress and thus fatigue failure is the location where the longest blade length occurs, termed the eye of the impeller. Thus this is a location where it is often desirable to induce residual compressive stresses which will lower the steady tensile stress occurring in rotation, thereby increasing the capability of this location for vibratory stress. However, the eye location is not usually the location where the highest tensile stress occurs during rotation. Other locations in the impeller usually experience higher steady tensile stresses during rotation than the eye location. If an attempt is made to introduce a residual compressive stress immediately at the eye location by causing local yielding at the eye location, excessive yielding may occur at other locations in the impeller experiencing higher steady tensile stresses such as to render the impeller useless for service.

The object of the present invention is to provide a method for improving the operating stress capability of a body to be subjected to rotation.

It is a feature of this invention that the operating stress capability of a body in rotation is improved by introducing beneficial residual stresses at a selected location in the body having high local stress levels.

It is another feature of this invention that the operating stress capability of a body in rotation is improved by inducing tolerable local yielding at locations in the body having high local stress levels.

It is an advantage of this invention that the operating stress capability of a body in rotation is improved simply by a series of successive rotations at selected peak speeds higher than the design speed.

It is an advantage of this invention that the operating stress capability of a selected location in a body can be improved when the selected location is not the location experiencing the highest local steady tensile stress in the body.

SUMMARY OF THE INVENTION

This invention provides a method for improving the capability of a body to withstand stress experienced during rotation by inducing at a selected location in the body a residual compressive stress which opposes the steady tensile stress experienced at the selected location during rotation of the body. The method comprises rotating the body at a succession of increasing peak speeds so as to induce tolerable yielding and residual compressive stress at each location experiencing higher steady tensile stress than the selected location. The succession proceeds from the location having the highest steady tensile stress above that experienced at the selected location to the location having the lowest steady tensile stress above that experienced at the selected location. When residual compressive stress is induced at all such locations so that there are no remaining locations experiencing a steady tensile stress above that experienced at the selected location, the body is rotated to a peak speed to induce tolerable yielding and residual compressive stress at the selected location.

DETAILED DESCRIPTION OF THE INVENTION

Figure 1:
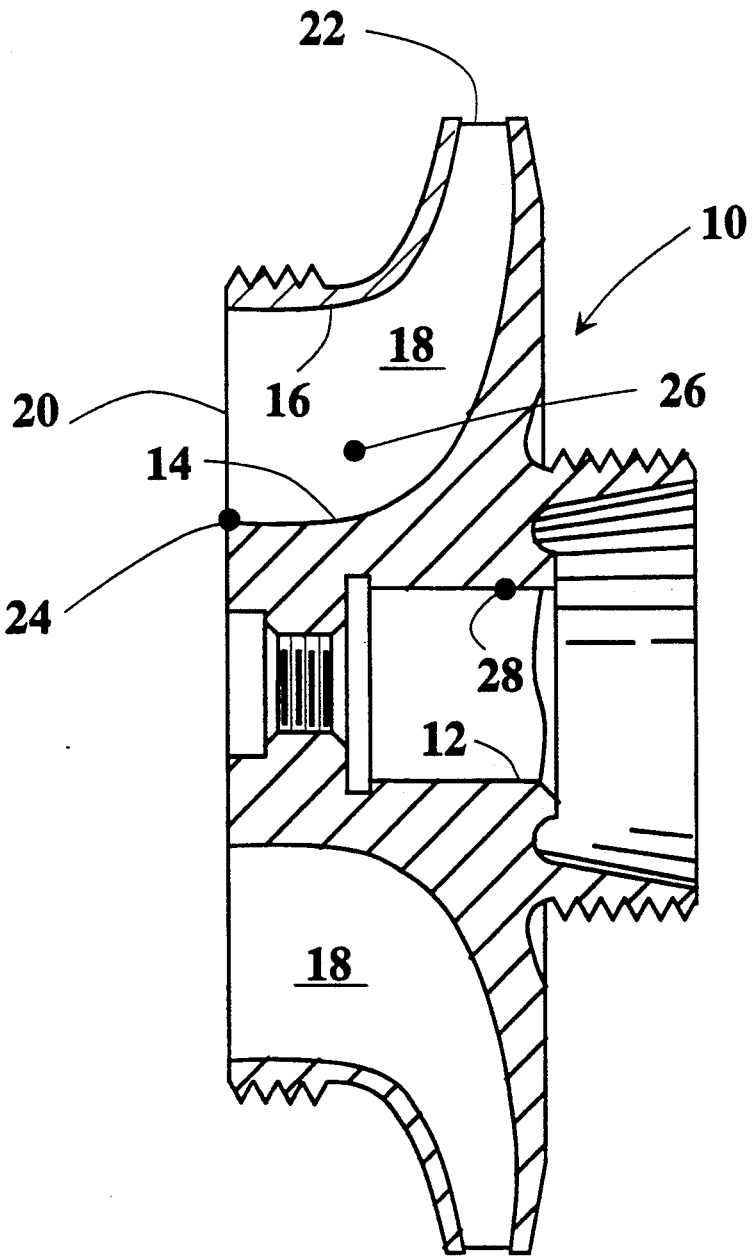
FIG. 1 is a cross-section of an impeller to which the method of this invention is applied as an example.

Depicted in FIG. 1 is a typical impeller configuration. The impeller 10 has a hub 12 for mounting on a shaft (not shown). An inner boundary 14 and an outer shroud 16 are connected locally by blades 18 to form multiple identical channels for fluid flow. One extremity of each channel has a large flow area 20 axially aligned for fluid flow and is termed the eye of the impeller. The other extremity of each channel has a small flow area 22 radially aligned for fluid flow. From the eye, the flow area of each blade channel continuously decreases to a minimum area at the other extremity of the channel. When the impeller is used in a compressor, fluid enters the eye of the impeller, and is accelerated in the impeller. When the impeller is used in a turbine, the fluid exits at the eye 20 of the impeller, and is decelerated in the impeller.

In either case, the eye in the impeller has a location 24 of concern with regards to stress. The eye location 24 usually does not experience the highest steady stress in the impeller. However, the blades in the eye region have a long unsupported length. Thus they are susceptible to turbulence and other strong excitations which produce vibratory stresses, which can quickly lead to fatigue failure. Thus it is desirable to improve the stress capability of the impeller specifically in this location.

Typically an impeller is designed to operate at a maximum intended steady service speed which is termed the design speed. If an attempt to introduce beneficial compressive residual stresses at a selected location such as the eye location is made simply by rotating the impeller to a speed where a sufficient amount of yielding will occur at the eye, other locations which experience higher steady tensile stress in rotation may yield excessively. Excessive yielding may be observed as distortion, imbalance or rupture of the impeller. The method of this invention obviates this intolerable difficulty.

Figure 2:
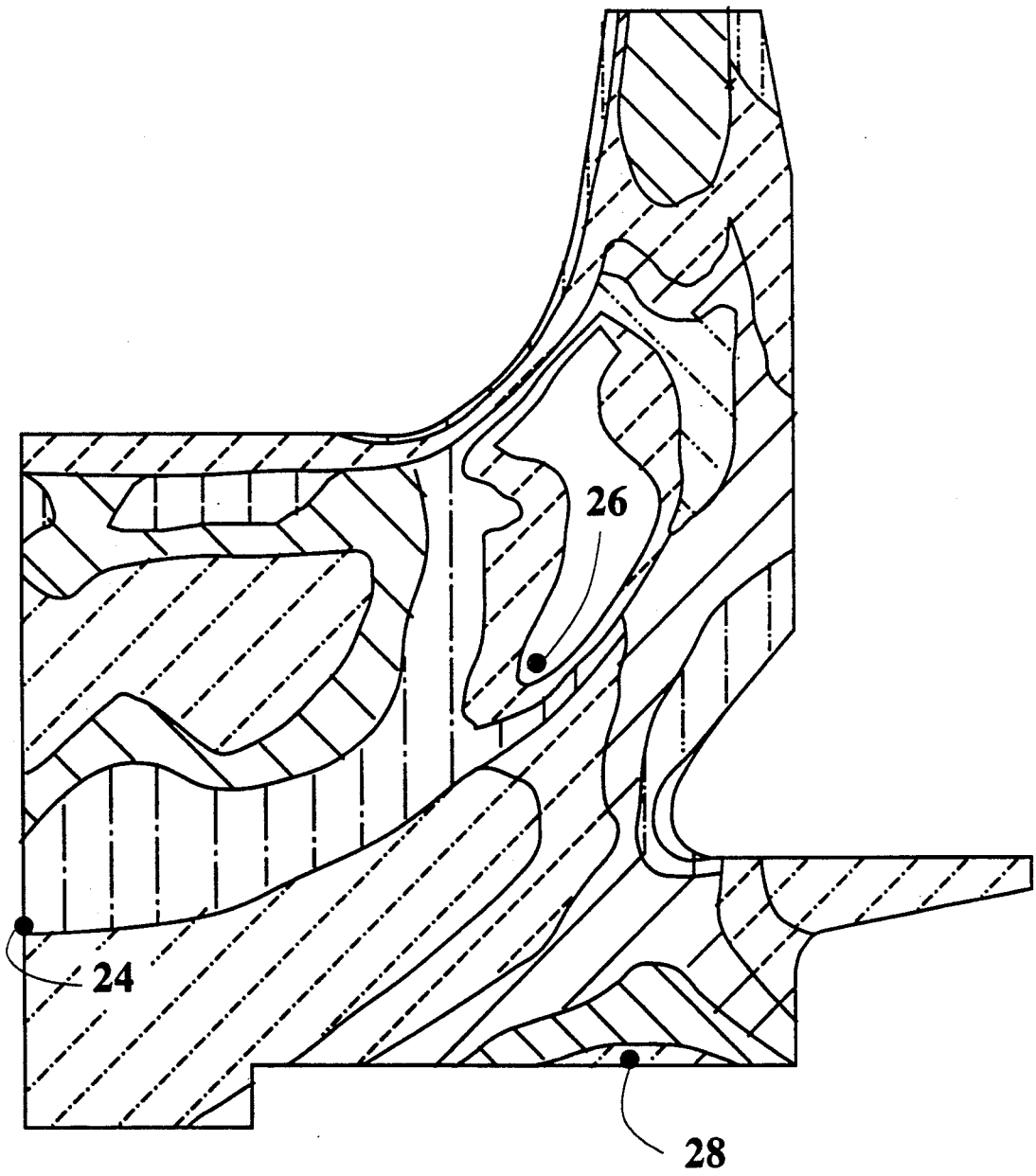
FIG. 2 is a plot of steady tensile stresses in a portion of the impeller shown in FIG. 1 at design rotational speed as obtained by finite element analysis.

For the purposes of illustration, this invention will be described as applied to an impeller fabricated of wrought 7175-T74 aluminum, a common impeller material. This material is ductile and can yield or deform locally before ultimate rupture occurs, which is a requirement for the practice of this invention. As determined by finite element analysis such as depicted in FIG. 2, at a design rotational speed of 23,580 rpm, the eye location 24, which is the selected location for the introduction of beneficial compressive residual stresses, experiences a steady stress of 10,300 psi. However, finite element analysis indicates two locations which experience higher steady stresses than the eye. The location having the highest steady stress above that at the eye location 24 is an interior blade location 26, which has a steady tensile stress of 14,680 psi. The location having the next highest steady tensile stress above that at the eye location 24 is a hub location 28, which has a steady tensile stress of 12,100 psi.

The initial step for developing residual compressive stresses at the eye is to rotate the impeller to a peak speed to cause sufficient local yielding at the interior blade location to develop residual compressive stresses so that this location can withstand subsequent higher speeds selected to develop residual compressive stresses at other locations, including the eye. The yielding must be tolerable, that is, limited so that the impeller is not unbalanced so that it cannot be operated subsequently at high rotational speeds, nor distorted so that it is useless.

An often useful criterion is to limit the yielding to 25% of the tensile elongation capability of the material comprising the impeller. This requires selecting a peak speed which induces yielding of 25% or less of the tensile elongation capability of the material. However, 7175-T74 aluminum is very ductile, and has a tensile elongation capability of 12%. Hence 25% of this capability is 3%, an amount which may produce unbalance or unacceptable distortion. An alternate criterion is to limit the yielding to 1% strain in the impeller material, which is considered to result in tolerable yielding in this case. This requires selecting a peak speed which induces yielding producing 1% or less strain in the material. In practice, a rotational speed is selected which is equal to or less than the lowest speed of those causing: yielding of 25% of the tensile elongation capability of the material and yielding producing 1% strain in the material.

In 7175-T74 aluminum, 1% strain is produced by a stress of 56,550 psi. The corresponding rotational speed that will produce this stress is calculated from the well known relationship that centrifugal force, and thus stress, is proportional to the speed of rotation squared. Using the design-point stress at the interior blade location predicted by finite element analysis as a base, the rotational speed to produce 56,550 psi at this location is:

$$N = N_d\sqrt{\sigma/\sigma_d} = 23{,}580\sqrt{56{,}550/14{,}680} = 46{,}200 \text{ rpm, where}$$

N is rotational speed, $N_d$ is the design rotational speed, $\sigma$ is stress, and $\sigma_d$ is the stress at the design speed.

The rotational speed calculated from this relationship is conservatively rounded to 45,000 rpm. This speed produces a stress of 53,500 psi at the interior blade location, as calculated from the relationship already given.

The initial step in the method is to rotate the impeller to a first peak speed of 45,000 rpm in a spin pit evacuated by a mechanical forepump. A mechanical forepump will produce a pressure level usually at least equal to less than 0.1 mm of mercury, typically a pressure level of 0.005 mm of mercury to 0.02 mm of mercury. The reduced pressure mitigates viscous pumping effects such as turbulence and adiabatic heating on the impeller. The rotation to the first peak speed is performed to cause tolerable local yielding at the interior blade location. On the stress-strain diagram depicting behavior at the interior blade location, FIG. 3, the step of rotating the impeller to the first peak speed is shown as the span along the stress-strain line for 7175-T74 aluminum from point 1 to point 2. Point 2 lies on the curved portion of the stress-strain line indicating that the elastic limit has been exceeded and that the material has yielded.

Figure 3:
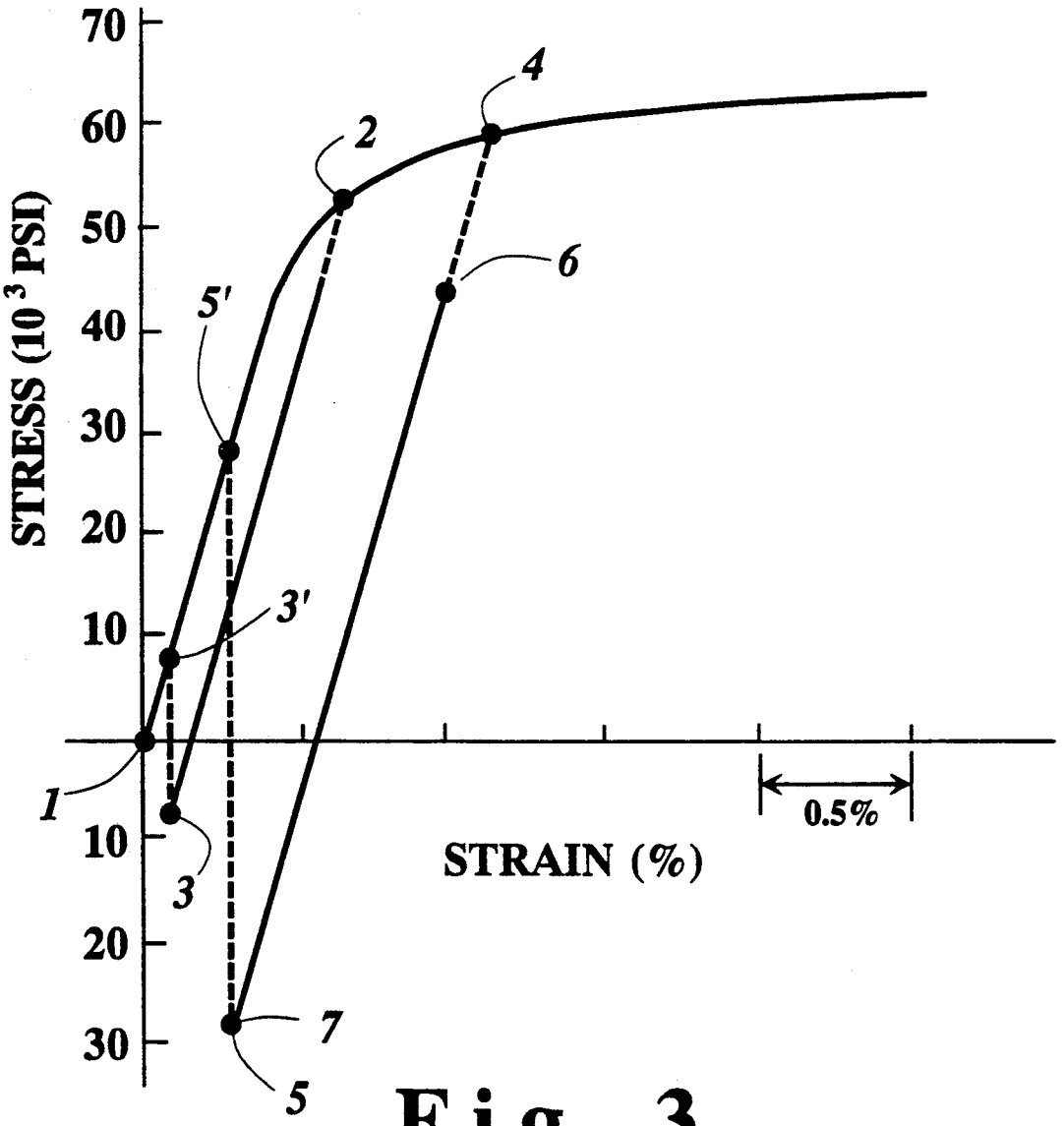
FIG. 3 is a stress-strain diagram showing the behavior at an interior blade location in the impeller of FIG. 1 during the application of the method of this invention.

Optionally, the rotational speed of the impeller may now be reduced to a speed below that at which yield began to occur, or to zero. At zero speed, the applied loading on the impeller is relieved, and the impeller unloads in a linear, elastic manner from point 2 to point 3 on FIG. 3. The yielded material at the interior blade location is forced into a state of residual compressive stress by neighboring material which has not yielded. The interior blade location thus develops a residual compressive stress of 7500 psi shown as point 3 on FIG. 3. The location of point 3 on FIG. 3 is estimated by considering a force balance around the interior blade location material where the yielding has occurred and a compressive residual stress now exists. The surrounding material supplies an equal and opposite stress, and also experiences an equal strain. Hence, the compressive stress in the yielded material must lie the same distance below the zero stress line as the stress in the unyielded material lies above the zero stress line. On FIG. 3, the latter point is shown as point 3', which lies directly above point 3.

Using the square relationship already given, the stress developed by the first peak speed at the hub location and at the eye location are calculated as 44,200 and 37,700 psi, respectively. These stresses are plotted as point 2 in FIG. 4 for the hub, and in FIG. 5 for the eye. These stresses are below the yield stress for the material, and consequently no compressive stresses are developed at these locations when the centrifugal stresses are relieved.

Next in the method is to develop a residual compressive stress at the location then experiencing at design speed the highest steady tensile stress above that at the selected location, if there be one. In this example, this occurs at a location at the hub. The same analysis as performed for the interior blade location is performed for the hub location. This results in selecting a peak speed of 50,000 rpm for the next step in the method. To induce tolerable yielding at the hub location, the impeller is spun to a second peak rotational speed of 50,000 rpm, which on FIGS. 3, 4, and 5, is shown as point 4.

Figure 4:
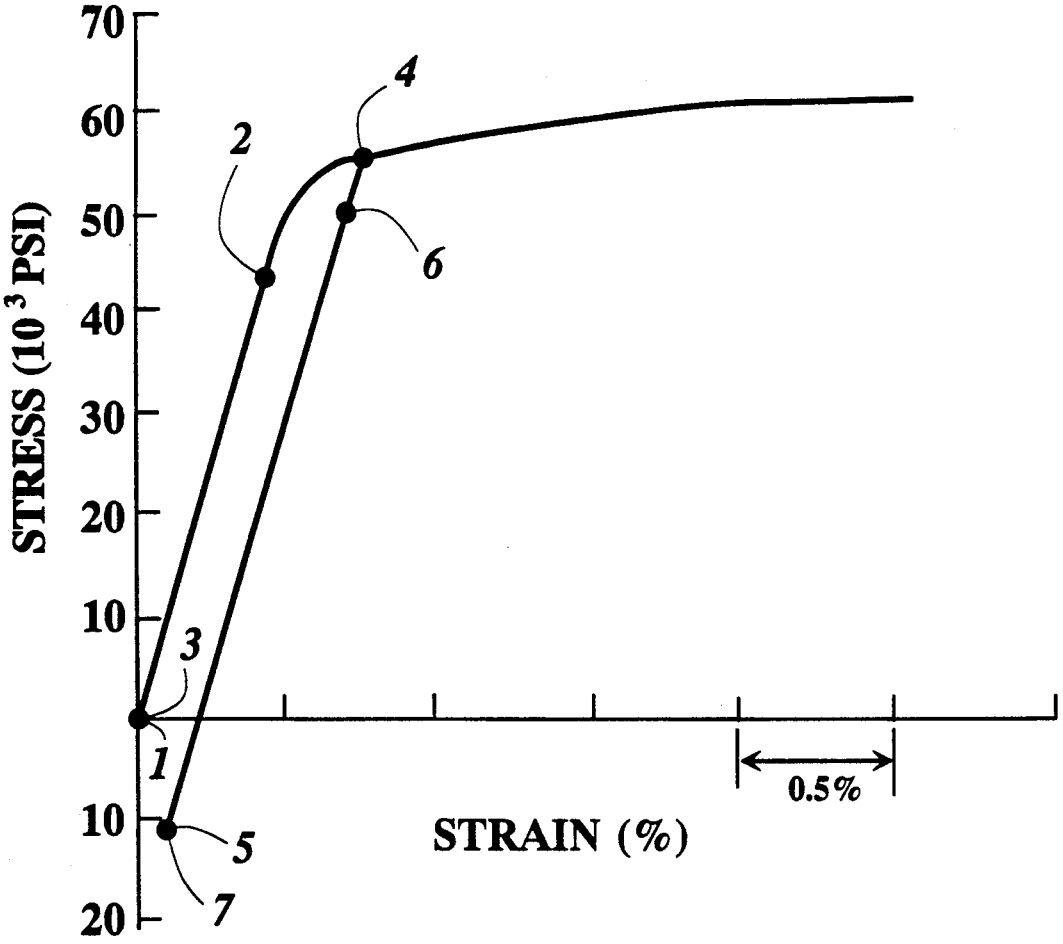
FIG. 4 is a stress-strain diagram showing the behavior at a hub location in the impeller of FIG. 1 during the application of the method of this invention.
Figure 5:
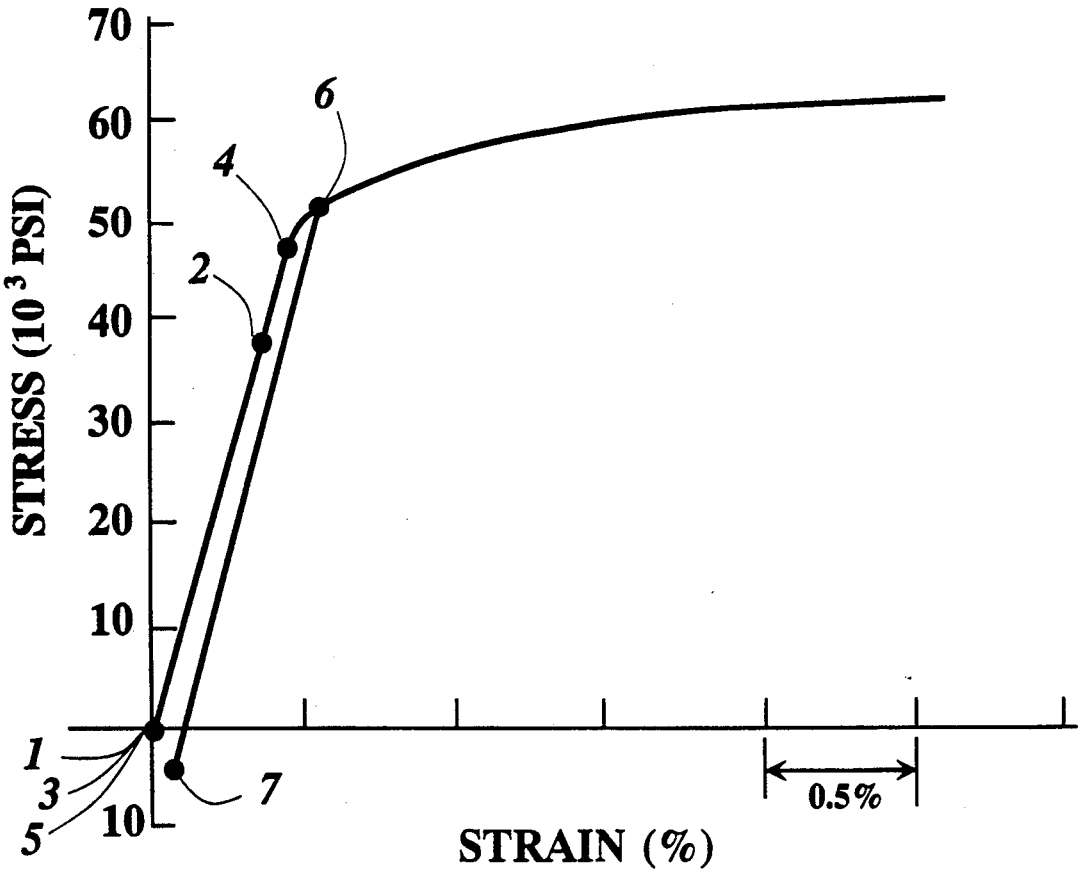
FIG. 5 is a stress-strain diagram showing the behavior at the selected location, namely the eye location, in the impeller of FIG. 1 during the application of the method of this invention.

Optionally, the speed then is reduced to zero, which on FIGS. 3, 4, and 5, is shown as point 5. On FIG. 3, it is seen that an additional amount of yielding occurs at the blade interior at 50,000 rpm, which raises the residual compressive stress at this location to 28,200 psi. Point 5' is the corresponding tensile stress that is applied by the material surrounding the interior blade location. On FIG. 4, it is seen that at the hub, in spinning to 50,000 rpm, a residual compressive stress of 11,200 psi results. On FIG. 5 for the eye, it is seen that no compressive stress develops at the eye at 50,000 rpm.

In this example, two locations had steady tensile stresses higher than the selected location. However, there could be one, two, three or more locations with a steady tensile stress higher than the selected location, to which the method of this invention is equally applicable. Having developed a residual compressive stress at all of the locations initially having a rotational stress higher than that at the selected location, namely the eye, it is now possible to develop a residual compressive stress at the eye. By the same sort of analysis as before, a third peak speed of 52,500 rpm is selected, and the impeller is spun to this peak speed. This point is shown as point 6 on FIGS. 3, 4, and 5. On FIG. 3, it is seen that no additional amount of yielding occurs at the blade interior. On FIG. 4, it is seen that no additional yielding occurs at hub. On FIG. 5, it is seen that yielding occurs at the eye.

Upon reducing the speed to zero, the impeller is again unloaded. This point is shown as point 7 on FIGS. 3, 4, and 5. On FIG. 5, it is seen that at the eye, the yielding at the last peak speed produces a residual compressive stress of 5,600 psi. Thus at the design rotational speed, the steady stress at the eye is 10,300−5,600=4,600 psi, a decrease of 45%.

Figure 6:
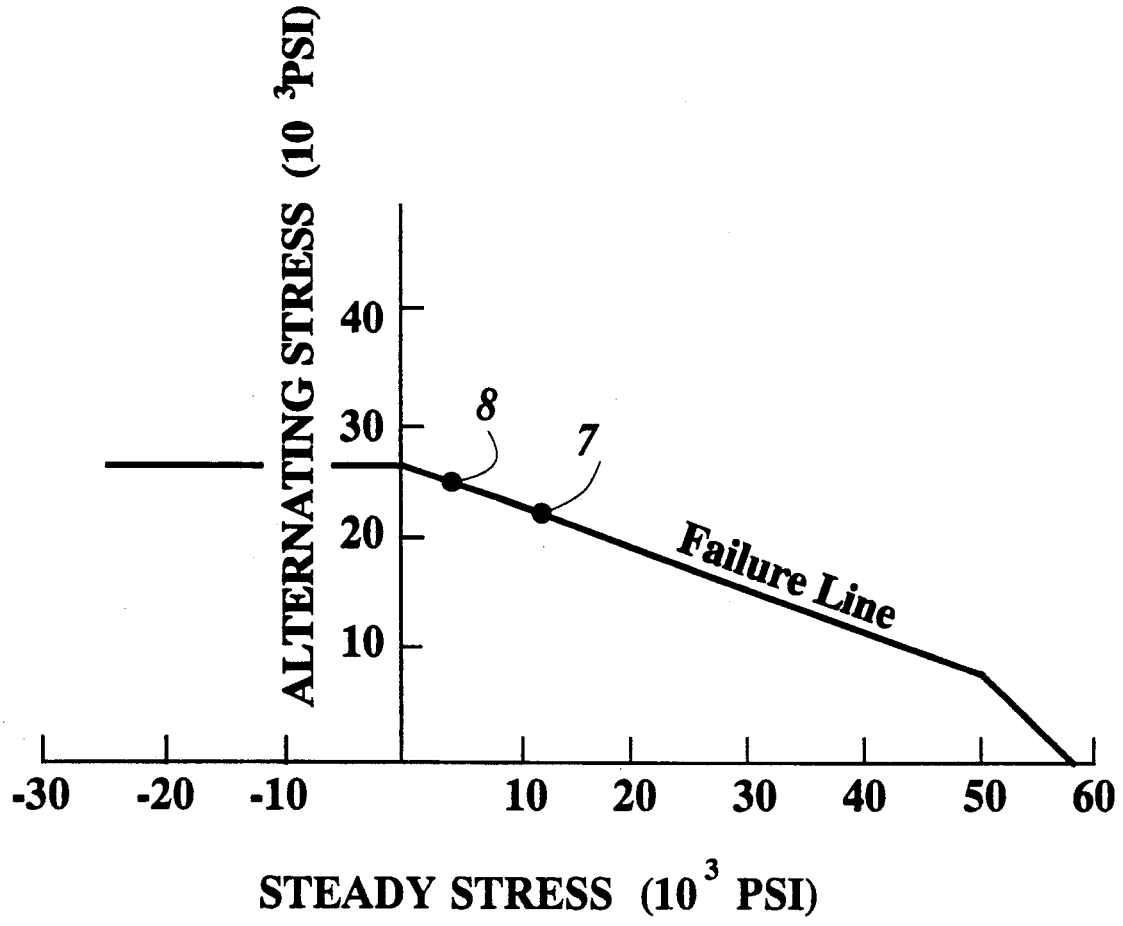
FIG. 6 is a Goodman diagram for the material comprising the impeller of FIG. 1, on which diagram the effect of applying the method of this invention at the eye is shown.

The benefits of using the method provided by this invention may be further assessed by reference to a Goodman diagram wherein the material failure line is plotted as function of alternating stress and steady stress, as shown in FIG. 6. At the eye, before applying the method to introduce beneficial residual stress, the steady stress is 10,300 psi at the design rotational speed. According to the Goodman diagram, FIG. 6, at point 7, with a steady stress of 10,300 psi, the allowable alternating stress, typically introduced by vibration, is 21,500 psi. By applying the method of this invention, a compressive residual stress of 5,600 psi is introduced whereby the steady stress at the eye is then 4,700 psi at the design speed. At this steady stress, which on FIG. 6 is point 8, the allowable alternating stress now is 24,200 psi, an increase of 12.6%.

In a configuration as complex as a turbomachine impeller, certain locations may experience compressive stresses in operation. Such locations may develop residual tensile stresses in the practice of this invention. Usually however, the steady stresses at such locations are not critically high. Also the residual tensile stresses which develop at such locations are not large so that in operation at the design speed, the net operating stress remains compressive. According to the Goodman diagram for 7175-T74 aluminum, FIG. 6, as is typical for ductile materials, the failure line is flat for compressive stresses. Thus typically, the capability of the impeller for alternating stress, at any location which develops a residual tensile stress during the practice of this invention, is not affected.

While the invention has been described as an example with reference to specific embodiments, it will be appreciated that it is intended to cover all modifications and equivalents within the scope of the appended claims.

What is claimed is:

1. A method for improving the capability of a body to withstand stress in rotation by inducing tolerable yielding and residual compressive stress at a selected location in said body, said method comprising:

(a) rotating said body at a succession of increasing peak speeds so as to induce tolerable yielding and residual compressive stress at each location experiencing higher steady tensile stress during rotation than said selected location, the succession proceeding from the location having the highest stress above that experienced at said selected location to the location having the lowest stress above that experienced at said selected location; and (b) rotating said body to a peak speed to induce tolerable yielding and residual compressive stress at said selected location.

2. The method as in claim 1 wherein each of said peak speeds to induce yielding induces yielding of 25% or less of the tensile elongation capability of the material comprising said body.

3. The method as in claim 1 wherein each of said peak speeds to induce yielding induces yielding producing 1% or less strain in the material comprising said body.

4. The method as in claim 1 wherein each of said peak speeds to induce yielding is equal to or less than the lowest speed of those inducing: yielding of 25% of the tensile elongation capability of the material comprising said body and yielding producing 1% strain in the material comprising said body.

5. The method as in claim 1 wherein said rotations are performed in an environment having a pressure of about or less than 0.1 millimeters of mercury.

6. The method as in claim 1 wherein after rotating said body to a peak speed, the speed of rotation is reduced to a speed below that which began to induce yielding in raising the body to said peak speed.

7. The method as in claim 1 wherein after rotating said body to a peak speed, the speed of rotation is reduced to substantially zero speed.

8. An impeller which has been processed according to the method of claim 1.

* * * * *